US008109787B1

(12) United States Patent
Kun-Tse

(10) Patent No.: US 8,109,787 B1
(45) Date of Patent: Feb. 7, 2012

(54) SWIVEL CONNECTOR

(76) Inventor: Yen Kun-Tse, New Taipei (TW)

( * ) Notice: Subject to any disclaimer, the term of this patent is extended or adjusted under 35 U.S.C. 154(b) by 0 days.

(21) Appl. No.: 13/110,779

(22) Filed: May 18, 2011

(51) Int. Cl.
*H01R 9/05* (2006.01)

(52) U.S. Cl. ..... 439/578

(58) Field of Classification Search ..... 439/578, 439/675, 352, 268
See application file for complete search history.

(56) References Cited

U.S. PATENT DOCUMENTS

| | | | | |
|---|---|---|---|---|
| 3,761,115 | A | 9/1973 | Papasian | |
| 3,957,331 | A * | 5/1976 | Tantillo et al. | 439/20 |
| 3,963,291 | A | 6/1976 | Maloof | |
| 4,003,616 | A | 1/1977 | Springer | |
| 4,601,497 | A * | 7/1986 | Bartholomew | 285/319 |
| 5,052,724 | A | 10/1991 | Konrad | |
| 5,413,387 | A | 5/1995 | Bartholomew | |
| 5,803,750 | A | 9/1998 | Purington et al. | |
| 6,190,180 | B1 | 2/2001 | Purington et al. | |
| 7,304,241 | B2 * | 12/2007 | Trieb et al. | 174/74 R |
| 2008/0042433 | A1 * | 2/2008 | Smith | 285/276 |
| 2009/0246977 | A1 * | 10/2009 | Rashkover | 439/18 |
| 2011/0203065 | A1 * | 8/2011 | Cassar | 15/144.2 |

* cited by examiner

*Primary Examiner* — Tulsidas C Patel
*Assistant Examiner* — Phuongchi Nguyen
(74) *Attorney, Agent, or Firm* — Stetina Brunda Garred & Brucker

(57) ABSTRACT

A swivel connector for coupling a cable to a terminal is disclosed. There is a socket contact plug in electrical communication with the terminal, and a fixed joint bushing attachable to the terminal with the socket contact plug extending therethrough. A joint housing is rotatably engaged to the fixed joint bushing. There is a primary terminal axially mounted to and electrically isolated from the joint housing, and includes an inner sleeve contact that is frictionally engaged to the socket contact plug. An outer sleeve contact is fixed to the joint bushing, and is also in electrical communication with the joint housing and with the terminal. The joint housing is rotatably engaged to the outer sleeve contact.

21 Claims, 3 Drawing Sheets

SWIVEL CONNECTOR

CROSS-REFERENCE TO RELATED APPLICATIONS

Not Applicable

STATEMENT RE: FEDERALLY SPONSORED RESEARCH/DEVELOPMENT

Not Applicable

BACKGROUND

1. Technical Field

The present disclosure relates generally to components for interconnecting electrical devices, and more particularly, to a connector for a conductive cable that rotates or swivels about the terminal to which it is engaged.

2. Related Art

Electronic systems are typically comprised of several distinct sub-components or hardware device modules that are interconnected. Each of the sub-components serves a specific purpose, which together in combination provides the overall functionality of the system. There are numerous examples of such modular systems in a variety of fields. While higher-level functionalities may be incorporated into different components, a simple example is an external power supply. A battery or a generator may provide electrical power, but the form in which it is provided may not be suitable for a given electronic device. Thus, a power supply including a transformer and/or signal conditioning circuitry can be connected to the source. As one example application, a vehicle-mounted Global Positioning System (GPS) receiver may be powered by an external power supply that is connected to the primary battery of the vehicle.

A common connection modality between such modular components is an electrically conductive cable that has at least one line dedicated for signal transmission. One or both of the modular components may have a terminal. In some cases, the cable may be attached permanently to component, in which case a terminal would not be necessary therefor. The free end(s) of the cable have connectors that can be mated to the terminal. The connector (on the cable end) and the terminal (on the component end) are typically configured in pairs, in which a socket is fitted within a receptacle and electrical contacts of the two are connected to each other. The length of the interconnection between various components may also be increased by linking socket/receptacle pairs of multiple cables. Numerous connector standards define various dimensional features of the connectors and terminals to ensure physical interconnectivity. At a minimum, the connector standards define which contacts on the terminal correspond to the contacts of the connector, so that signals are consistently transmitted across the cable without one contact being cross-linked to a different contact. Thus, in the example of the power supply, the power line of the cable end is not shorted to ground, and so forth. In some instances, the standard may also define the contents of the signal traversing various lines within the cable.

For applications where the sub-components are frequently connected and disconnected, the durability of the connector between the cable and the terminal is a significant design objective. A related issue associated with the frequent movement or connection/disconnection of cables is its propensity to twist, tangle, and/or kink, leading to disorder at the very least, and possibly even damage to the cable, the connector, and the electrical components. With the vehicle-mounted GPS units mentioned in the example above, the power cable may be routed from a variety of different directions. Thus, various rotating or swiveling connectors have been developed, though weaknesses associated with the moving joints of such connectors persist. A further design parameter of connectors is the environment in which the electronic systems are deployed. In many cases, the systems are deployed under harsh conditions such as dusty/sandy environments, wet environments, and extreme cold or hot temperature environments.

Accordingly, there is a need in the art for an improved swivel connector that is resilient to withstand frequent engagement and disengagement from the terminal, as well as being substantially impervious to environmental conditions.

BRIEF SUMMARY

In accordance with one embodiment, there is disclosed a swivel connector for coupling a cable to a terminal. The swivel connector may include a socket contact plug in electrical communication with the terminal. Additionally, there may be a fixed joint bushing attachable to the terminal with the socket contact plug that extends therethrough. There may also be a joint housing that is rotatably engaged to the fixed joint bushing. The swivel connector may further include a primary terminal that is axially mounted to and electrically isolated from the joint housing. This primary terminal may include an inner sleeve contact that is frictionally engaged to the socket contact plug. Furthermore, there may be an outer sleeve contact that is fixed to the joint bushing. The outer sleeve contact may also be in electrical communication with the joint housing and with the terminal. The joint housing may be rotatably engaged to the outer sleeve contact.

Another embodiment of the present disclosure contemplates a swivel connector with various features. The swivel connector may couple a cable with a first line and a second line to a terminal with a corresponding first lead and a second lead. In various embodiments, the swivel connector may include a coupling nut with a hollow cylindrical portion. Additionally, there may be a socket body that is in a freely rotating coaxial engagement with the coupling nut. The socket body may extend through the hollow cylindrical portion. The swivel connector may further include a fixed joint bushing that is attached to the socket body and defines an axial interior first bushing contact slot. There may also be a joint body that is mounted to the fixed joint bushing and the socket body in a coaxial relationship thereto. Furthermore, there may be a joint housing that is rotatably engaged to the joint body. The swivel connector may include a first socket contact that is electrically connectible to the first lead of the terminal. The first socket contact may extend through the socket body and the first bushing contact slot. In a related feature, there may be a first connector terminal that is fixed to the joint housing in electrical isolation therefrom. The first connector terminal may be in a continuous frictional rotating engagement with the first socket contact, and may also be connectible to the first line of the cable. Another contemplated feature of the swivel connector is a second socket contact that is electrically connectible to the second lead of the terminal, and also extends through the socket body. There may also be a second connector contact that includes a sleeve portion fitted at least partially over the fixed joint bushing and between the joint body. The second connector contact may be in electrical communication with the second socket contact and electrically isolated from the first socket contact. Furthermore, the second connector contact may be connectible to the second line of the cable. The present invention will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

Various embodiments of the present disclosure contemplate a swivel connector for coupling a cable to a terminal. In one particular application detailed more fully below, the connector is for a power supply cable to an electronic system deployed in harsh environmental conditions, such as a military vehicle-mounted Global Positioning System (GPS) receiver. Such cables are frequently connected and disconnected while being routed from a variety of different directions. The features of the swivel connector are suitable for such applications, though it is to be understood that it is not limited thereto.

The detailed description set forth below in connection with the appended drawings is intended as a description of the several presently contemplated embodiments of these connectors, and is not intended to represent the only form in which the disclosed invention may be developed or utilized. The description sets forth the functions and features in connection with the illustrated embodiments. However, that the same or equivalent functions may be accomplished by different embodiments that are also intended to be encompassed within the scope of the present disclosure. It is further understood that the use of relational terms such as first and second, top and bottom, distal and proximal, and the like are used solely to distinguish one from another entity without necessarily requiring or implying any actual such relationship or order between such entities.

Figure 1:
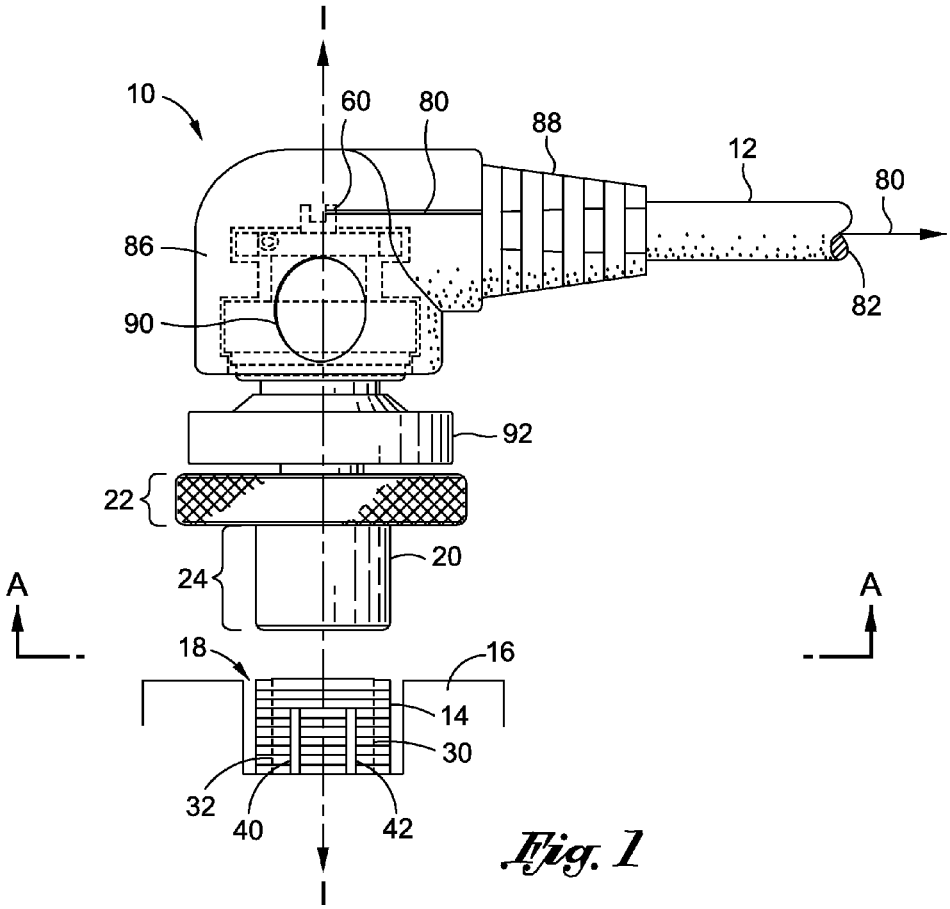
FIG. 1 is an exterior side plan view of one embodiment of a swivel connector fixed to a conductive cable and a molded back shell, with select interior features being shown in broken lines.

With reference to FIG. 1, a swivel connector 10 attached to a cable 12 is shown in a state decoupled from a terminal 14, though axially aligned with the same in such a manner to ready for coupling. The terminal 14 is understood to be fixed to an electronic component 16. In continuing with the example above, the electronic component 16 may be a vehicle-mounted GPS receiver, though any other device may be substituted. The GPS receiver or the electronic component 16 may receive power over the cable 12, with the end opposite to the swivel connector 10 being connected to an electrical power source (not shown).

Generally, the swivel connector 10 is configured for secure coupling to the terminal 14. In further detail, there is a recess 18 defined by the electronic component 16, within which certain portions of the swivel connector 10 are inserted. As mentioned previously, the terminal 14 is typically a receptacle, and mates with a corresponding socket on the swivel connector 10. The recess 18 thus defines a part of the receptacle. Variously illustrated in FIGS. 1-5, the swivel connector 10 includes a coupling nut 20 defined by a knob section 22 and a socket section 24. The knob section 22 is understood to be wider than the socket section 24 or any other part of the swivel connector 10, as the end user grasps this portion to thread the swivel connector 10 on to the terminal 14. In this regard, the outer surface of the knob section 22 can have a knurled surface for increasing grip traction.

Figure 5:
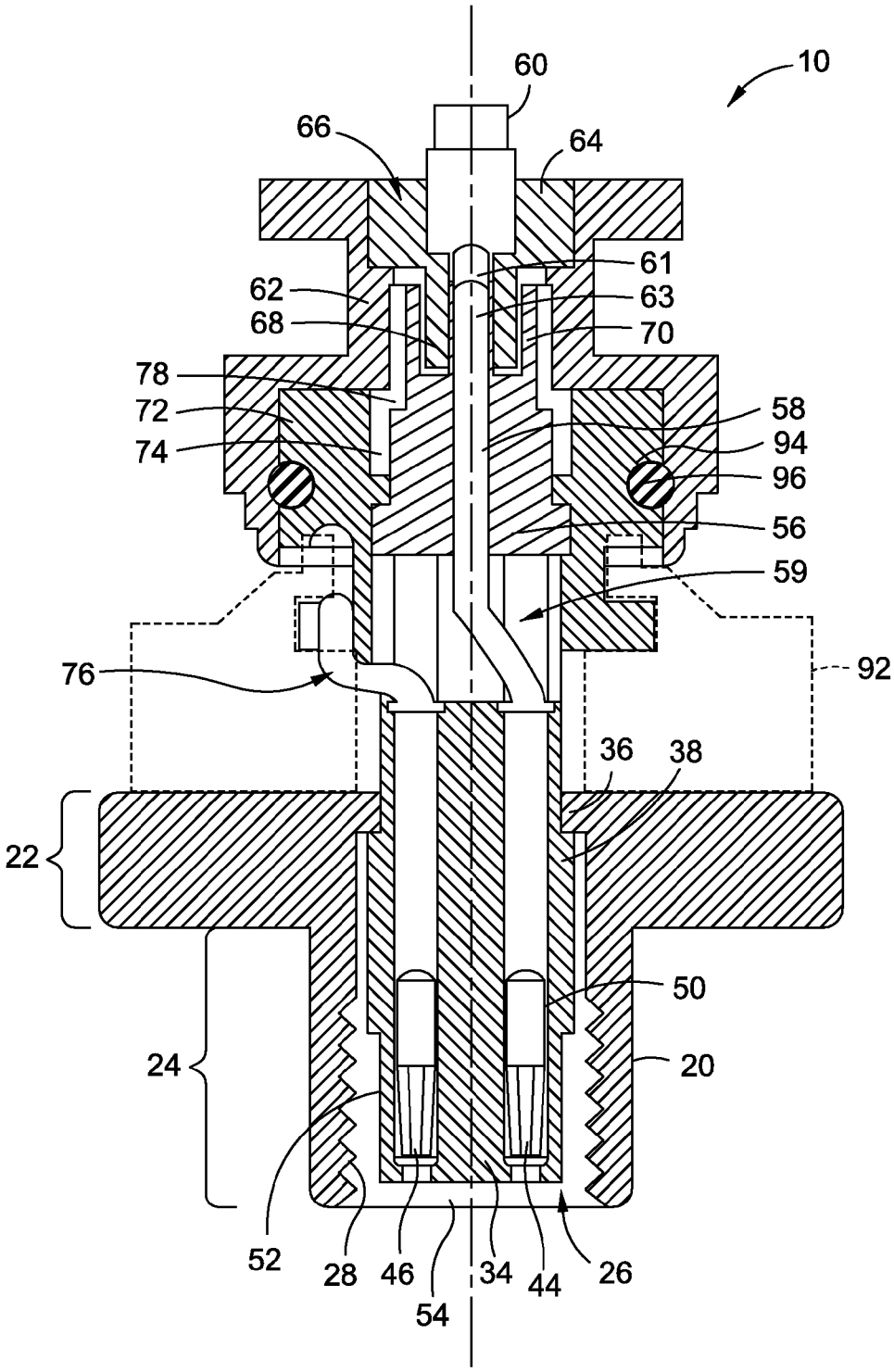
FIG. 5 is a cross-sectional view of the swivel connector taken along view B-B of FIG. 4.

FIG. 5 best illustrates the internal configuration of the coupling nut 20, which includes a hollow cylindrical portion 26. The inner circumference 28 of the cylindrical portion 26 is threaded, and is engageable to a correspondingly threaded receptacle post 30 disposed within the recess 18 as shown in FIG. 1. The receptacle post 30 is contemplated to have a generally cylindrical configuration, and also defines inner hollow cylindrical portion 32.

In accordance with another aspect of the present disclosure, the swivel connector 10 includes a socket body 34 that is in a freely rotating coaxial engagement with the coupling nut 20. More particularly, the socket body 34 extends through the aforementioned hollow cylindrical portion 26 of the coupling nut 20. The socket body 34 is understood to be fitted inside the inner hollow cylindrical portion 32 of the receptacle post 30. As shown in FIG. 5, the coupling nut 20 is defined by an inner lip portion 36 that is in abutting contact with a corresponding radially protruding portion 38 of the socket body 34. In this regard, the socket body 34 is understood to be retained within the hollow cylindrical portion 26 and prevented from further upward movement against the coupling nut 20. Along these lines, the downward movement against the coupling nut 20 is also prevented, the details of which will be considered more fully below.

Figure 2:
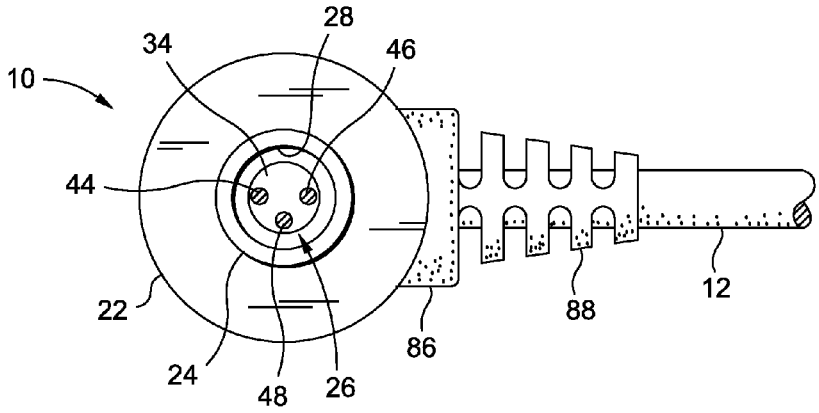
FIG. 2 is a bottom plan view of the swivel connector as shown in FIG. 1 along view A-A.

Within the inner hollow cylindrical portion 32 of the receptacle post 30, there are a first lead 40 and a second lead 42. These leads are understood to be electrical contacts and so are constructed of a suitably electrically conductive material such as gold plated bronze and so forth. In the contemplated exemplary configuration, the first lead 40 is associated with a power transmission path, while the second lead 42 is associated with common path. Referring to FIG. 2, disposed within the socket body 34 is a first socket contact 44 that is connected to a first line in the cable 12, and the a second socket contact 46 that is connected to a second line in the cable 12. In likewise fashion, the first socket contact 44 is associated with a power transmission path, and the second socket contact 46 is associated with a common path. Again, considering that the first socket contact 44 and the second socket contact 46 are utilized to make electrical connections, these components are likewise understood to be constructed of an electrically conductive material. To isolate one contact from the other, however, the socket body 34 is constructed of an electrically insulating material such as a composite of nylon and fiber. Although in FIG. 2 there is illustrated a third socket contact 48, for purposes of the presently disclosed embodiment of the swivel connector 10, this is not tied to a corresponding line in the cable 12.

The first socket contact 44 and the second socket contact 46 are disposed within a first socket contact slot 50 and a second socket contact slot 52, respectively, and are defined by the socket body 34. The first socket contact 44 and the second socket contact 46 are electrically conductive and flexible with slightly undersized dimensions relative to the dimensions of the first lead 40 and the second lead 42 of the terminal 14. When the first lead 40 and the second lead 42 are inserted into the first socket contact slot 50 and the second socket contact slot 52, respectively, it is understood that the first socket contact 44 and the second socket contact 46 expand slightly to frictionally engage the first lead 40 and the second lead 42. In this way, electrical contact between the first lead 40 and the first socket contact 44 is maintained, as is the electrical contact between the second lead 42 and the second socket contact 46.

When the swivel connector 10 is coupled to the terminal 14, the coupling nut 20 is threaded on to the receptacle post 30 and received within the recess 18. Furthermore, the position of the socket body 34 is fixed in relation to the receptacle post 30, and hence the terminal 14. As noted above, the coupling nut 20 includes an inner lip portion 36 that engages to the protruding portion 38 of the socket body 34. As the coupling nut 20 is threaded on to the receptacle post 30, the inner lip portion 36 exerts a downward retention force upon the protruding portion 38 of the socket body 34, thereby temporarily fixing the swivel connector 10 to the terminal 14. Since the socket body 34 is then disposed within the receptacle post 30 on the terminal 14, and the first lead 40 and the second lead 42 are inserted into the first socket contact slot 50 and the second socket contact slot 52, rotational movement of the socket body 34 is restricted. Although particular features of the swivel connector 10 as pertaining to the coupling nut 20 and the socket body 34 have been described, it will be appreciated that there are alternative configurations therefor. The dimensions and profiles of the socket body 34 and the coupling nut 20 in the illustrated embodiment are understood to comply with the Picofast®/MFS series connector produced by Hans Turck GmbH & Co, KG of Germany, though any other connector standard may be substituted.

Referring now to FIG. 5, the features of the swivel connector 10 that enable the attached cable 12 to rotate about axis 1-1 relative to the terminal 14 will be described. The socket body 34 extends through a central opening 54 defined by the coupling nut 20. The socket body 34 is attached to a fixed joint bushing 56, which like the socket body 34, is constructed of an electrically insulating material. The fixed joint bushing 56 has a generally cylindrical configuration coaxial with the axis 1-1. Furthermore, the fixed joint bushing 56 defines an axial interior first bushing contact slot 58, through which the first socket contact 44 is routed. The axis of the first bushing contact slot 58 is centered on and aligned with the axis 1-1. The first socket contact slot 50 has an axis that, while extending in a parallel relationship to the axis 1-1, is offset therefrom. In other words, the first socket contact slot 50 is not centered within the socket body 34. Accordingly, the first socket contact 44 is routed in an angular relationship between the first socket contact slot 50 and the first bushing contact slot 58; the first socket contact 44 thus has an angled section 59. In some contemplated embodiments, the angled section 59 may be a separate and independent component from the first socket contact 44 that is mechanically attached to establish an electrical connection. Along these lines, while the first socket contact 44 (and the second socket contact 46) has been previously referenced as a single contiguous part aside from the foregoing angled section 59, this is not necessary feature and the socket contacts may be divided into one or more other separate parts. Reference to a single socket contact is for purposes of simplification only. Any other suitable configuration may be employed for routing a conductive path from the socket body 34 to the center of the fixed joint bushing 56.

The socket body 34 and the fixed joint bushing 56 remain stationary relative to the terminal 14 when coupled thereto, so the first socket contact 44 likewise remains stationary. The swivel connector 10 further includes a first connector terminal 60 that is in continuous frictional rotating engagement with the first socket contact 44. In further detail, the first connector terminal 60 includes a sleeve portion 61 that is fitted over a plug portion 63 of the first socket contact 44. The sleeve portion 61 freely rotates around the plug portion 63 while remaining in electrical contact therewith. The sleeve portion 61 may be have slightly undersized dimensions relative to the plug portion 63, and being constructed of a flexible, electrically conductive material (metal), the sleeve portion 61 compresses against the plug portion 63. Although the sleeve portion 61 need not completely enclose the plug portion 63, it is understood that at any given rotation point, electrical contact between the two is maintained.

The first connector terminal 60 is attached to a joint housing 62, and more specifically, to a joint insulator 64 that is fixed to the joint housing 62. The joint insulator 64 is defined by a flanged portion 66 and a journal portion 68, with the first connector terminal 60 extending through a central axis thereof. The flanged portion 66 is mounted to the joint housing 62, and the journal portion 68 is rotatably engaged to a corresponding cylindrical bearing portion 70 defined by the fixed joint bushing 56. That is, the journal portion 68 of the joint insulator 64 is received in the cylindrical bearing portion 70 of the fixed joint bushing 56, and is rotatable about the axis 1-1. As indicated above, the first connector terminal 60 rotates, and the joint insulator 64 and the joint housing 62 to which it is attached, rotates as well. While the first connector terminal 60 is mechanically attached to the joint housing 62, it is electrically isolated therefrom. In this regard, the joint insulator 64 may be constructed of a non-conductive material such as polytetrafluouroethylene (PTFE).

The joint housing 62 is also rotatably engaged to a joint body 72, which is mounted to the fixed joint bushing 56 and the socket body 34 in a coaxial relationship thereto. Similar to the first socket contact slot 50 discussed above, the second socket contact slot 52 is parallel with the central axis 1-1 but offset therefrom. The second socket contact 46 is routed through the second socket contact slot 52, and is routed externally from the socket body 34 to electrically connect the same to a second connector contact 74. The second socket contact 46 is thus understood to include an angled section 76 for this purpose.

In further detail, the second connector contact 74 includes a sleeve portion 78 that is fitted at least partially over the fixed joint bushing 56. The sleeve portion 78 is thus sandwiched between the joint body 72 and the fixed joint bushing 56. The second connector contact 74 is fixed to the joint body 72 and the fixed joint bushing 56 in a non-rotating relationship, but the joint housing 62 is understood to rotate around the sleeve portion 78 as well as the joint body 72, as mentioned above. The second connector contact 74 is also routed to an external portion of the joint body 72 for electrically connecting to the second socket contact 46.

The joint body 72 is constructed of an electrically conductive material, which according to one embodiment is brass that may be coated with a layer of nickel. Thus, the joint body 72 is also electrically connected to the second connector contact 74. Indeed, this connection is maintained across the entire rotational range of the joint housing 62 relative to the joint body 72. Again, like the sleeve portion 61 of the first connector terminal 60, the sleeve portion 78 of the second connector contact 74 need not be completely encompassed by the joint housing 62, just that the electrical connection between these components is consistently maintained. It is noted that although there is a mechanical connection between the joint body 72, the second connector contact 74, and the fixed joint bushing 56, the first socket contact 44 is isolated therefrom, as the fixed joint bushing 56 is constructed of a non-conducting material. According to the one exemplary configuration discussed above, the second connector contact 74, as well as the other components noted herein as being electrically connected thereto including the joint body 72, the joint housing 62, and the second socket contact 46, are associated with a common signal path for the power supply.

Figure 3:
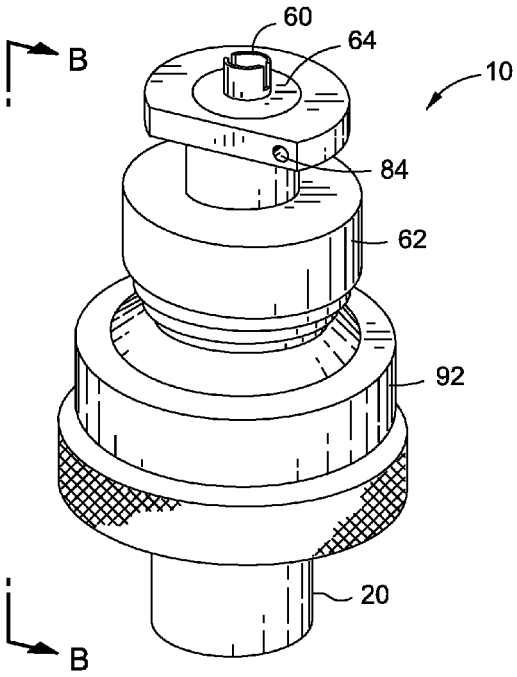
FIG. 3 is a perspective view of the swivel connector without the molded back shell.
Figure 4:
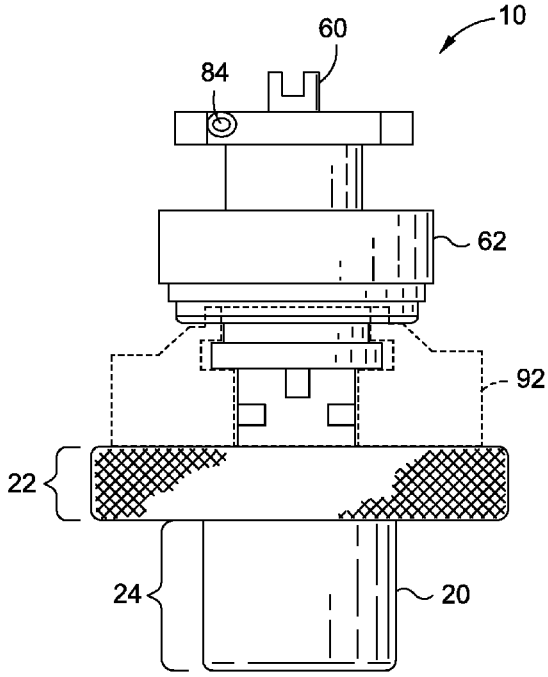
FIG. 4 is a side view of the swivel connector with a retainer thereof being shown in broken lines.

With reference again to FIG. 1, the first connector terminal 60 is connected to a first line 80 that is associated with a signal or power transmission path, while the joint housing 62 is connected to a second line 82 that is associated with a common signal path. In some embodiments, the common signal is carried over a conductive sheath surrounding a non-conductive sheath, and has been depicted thus in FIG. 1. As shown in FIG. 3 and FIG. 4, the joint housing 62 includes a wire anchoring recess 84, to which an extension from the conductive sheath of the second line 82 can be attached.

As noted above, protection from harsh external environments is one pertinent consideration for the swivel connector 10. One of the contemplated features, then, is a backshell 86 that substantially encloses the joint housing 62 and several other components of the swivel connector 10. It is understood that the backshell 86 is rigidly molded on to the joint housing 62 and related components. The cable 12 is attached to the backshell 86, and the junction between the two components includes relief collars 88 for strengthening the joint and limiting flex. For ease in manipulation, the backshell 86 may have a grip depression 90.

For further enclosing the otherwise exposed portions of the socket body 34, the joint body 72, and the second socket contact 46 is a retainer member 92. In particular, the retainer member 92 is fitted over and fixed to the socket body 34, and is axially interposed between the coupling nut 20 and the joint housing 62. It was previously noted that the upward, axial movement of the socket body 34 is limited by the inner lip portion 36 of the coupling nut 20. The downward, axial movement of the socket body 34, in turn, is understood to be limited by the retainer member 92. Being fixed to the socket body 34 and the joint body 72, the joint housing 62 and the backshell 86 rotate relative to the retainer member 92.

Partly in order to prevent environmental intrusion of the sleeve portion 78 of the second connector contact 74 and the first connector terminal 60, the joint body 72 defines a circumferential groove 94, within which a sealing member 96 is disposed. According to one contemplated embodiment, the sealing member 96 is an O-ring. As a further sealing measure, in addition to lubrication for smooth swiveling of the joint housing 62, the interface between the joint body 72 and the joint housing 62 includes a film of silicon grease, though any other suitable material may be substituted.

The particulars shown herein are by way of example and for purposes of illustrative discussion of the embodiments of the present disclosure only and are presented in the cause of providing what is believed to be the most useful and readily understood description of the principles and conceptual aspects. In this regard, no attempt is made to show details of the present invention with more particularity than is necessary, the description taken with the drawings making apparent to those skilled in the art how the several forms of the present invention may be embodied in practice.

What is claimed is:

1. A swivel connector for coupling a cable to a terminal, the swivel connector comprising:

a socket contact plug in electrical communication with the terminal;

a fixed joint bushing attachable to the terminal with the socket contact plug extending therethrough;

a joint housing rotatably engaged to the fixed joint bushing;

a primary terminal axially mounted to and electrically isolated from the joint housing, the primary terminal including an inner sleeve contact frictionally engaged to the socket contact plug;

an outer sleeve contact fixed to the joint bushing and being in electrical communication with the joint housing and with the terminal, the joint housing being rotatably engaged to the outer sleeve contact.

2. The swivel connector of claim 1, further comprising:

a socket body including a first socket contact connected to the socket contact plug and a second socket contact connected to the outer sleeve contact, the socket body, the first socket contact, and the second socket contact being connectible to the terminal.

3. The swivel connector of claim 1, further comprising:

a joint body attached to the fixed joint bushing and partially mounted to the outer sleeve contact;

wherein the joint housing is additionally rotatably engaged to the joint body.

4. The swivel connector of claim 3, further comprising:

an annular sealing member disposed between the joint housing and the joint body.

5. A swivel connector for coupling a cable with a first line and a second line to a terminal with a corresponding first lead and a second lead, the swivel connector comprising:

a coupling nut including a hollow cylindrical portion;

a socket body in a freely rotating coaxial engagement with the coupling nut and extending through the hollow cylindrical portion thereof;

a fixed joint bushing attached to the socket body and defining an axial interior first bushing contact slot;

a joint body mounted to the fixed joint bushing and the socket body in a coaxial relationship thereto;

a joint housing rotatably engaged to the joint body;

a first socket contact electrically connectible to the first lead of the terminal and extending through the socket body and the first bushing contact slot;

a first connector terminal fixed to the joint housing in electrical isolation therefrom and being in a continuous frictional rotating engagement with the first socket contact, the first connector terminal being connectible to the first line of the cable;

a second socket contact electrically connectible to the second lead of the terminal and extending through the socket body; and a second connector contact including a sleeve portion fitted at least partially over the fixed joint bushing and between the joint body, the second connector contact being in electrical communication with the second socket contact and electrically isolated from the first socket contact, the second connector contact being connectible to the second line of the cable.

6. The swivel connector of claim 5, wherein the joint body defines a circumferential groove, the swivel connector further comprising:

an annular sealing member disposed within the groove for minimizing environmental exposure.

7. The swivel connector of claim 5, wherein the interface between the joint body and the joint housing includes a film of silicone grease.

8. The swivel connector of claim 5, wherein the fixed joint bushing is constructed of an electrically insulating material.

9. The swivel connector of claim 5, further comprising:

a retainer member fitted over and fixed to the socket body, the retainer member being axially interposed between the coupling nut and the joint housing.

10. The swivel connector of claim 5, further comprising:

a joint insulator defined by a flanged portion attached to the joint housing and a journal portion rotatably engaged to a corresponding cylindrical bearing portion defined by the fixed joint bushing.

11. The swivel connector of claim 5, wherein the hollow cylindrical portion of the coupling nut is threaded and defined by an inner lip portion in abutting contact with a corresponding radially protruding portion of the socket body.

12. The swivel connector of claim 5, wherein the socket body and the coupling nut are engageable to a corresponding receptacle of the terminal.

13. The swivel connector of claim 5, wherein the socket body defines a first socket contact slot and a second socket contact slot receptive to a respective one of the first lead and the second lead of the terminal.

14. The swivel connector of claim 13, wherein the first socket contact slot has an axis offset from a center axis of the socket body, the first socket contact being routed in an angular relationship between the axis of the first socket contact slot and the center axis of the socket body.

15. The swivel connector of claim 14, wherein the second socket contact slot has an axis offset from the center axis of the socket body.

16. The swivel connector of claim 5, wherein the joint housing is electrically connected to the second connector contact, the electrical connection between the second connector contact and the joint housing being maintained across the entire rotational range thereof over the sleeve portion of the second connector contact.

17. The swivel connector of claim 16, wherein:

the sleeve portion of the second connector contact is fixed to the joint body and the joint bushing in a non-rotating relationship; and the joint housing rotates around the sleeve portion of the second connector contact.

18. The swivel connector of claim 16, wherein:

the joint body is constructed of an electrically conductive material; and the second connector contact is electrically connected to the joint body.

19. The swivel connector of claim 16, wherein:

the first connector terminal and the first line of the cable corresponds to a signal transmission path; and the second connector contact and the second line of the cable corresponds to a common path.

20. The swivel connector of claim 16, wherein the joint housing defines a wire anchoring recess.

21. The swivel connector of claim 20, further comprising:

a molded backshell substantially enclosing the joint housing, the cable being attachable to the molded backshell with the first line routed therethrough to the first connector terminal and the second line routed therethrough to the wire anchoring recess on the joint housing.

* * * * *